US007212754B2

(12) United States Patent
Fujiwara

(10) Patent No.: US 7,212,754 B2
(45) Date of Patent: May 1, 2007

(54) IMAGE FORMING APPARATUS FORMING AN IMAGE BY THERMALLY FIXING A DEVELOPED IMAGE

(75) Inventor: Yasushi Fujiwara, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 257 days.

(21) Appl. No.: 10/971,027

(22) Filed: Oct. 25, 2004

(65) Prior Publication Data

US 2005/0095021 A1 May 5, 2005

(30) Foreign Application Priority Data

Oct. 30, 2003 (JP) ..... 2003-370813

(51) Int. Cl.
*G03G 15/20* (2006.01)

(52) U.S. Cl. ..... 399/33; 399/67; 399/69

(58) Field of Classification Search ..... 399/9, 399/31, 33, 38, 67, 68, 69, 70; 219/216; 347/156

See application file for complete search history.

(56) References Cited

U.S. PATENT DOCUMENTS 5,329,342 A * 7/1994 Shirai et al. ..... 399/33
5,633,704 A * 5/1997 Suzuki et al. ..... 399/69
6,580,883 B2 * 6/2003 Suzumi ..... 399/69

FOREIGN PATENT DOCUMENTS

| | | |
|---|---|---|
| JP | A 1-293379 | 11/1989 |
| JP | A 8-292679 | 11/1996 |
| JP | B2 2636231 | 4/1997 |
| JP | A 10-83878 | 3/1998 |

* cited by examiner

*Primary Examiner*—Hoan Tran
(74) *Attorney, Agent, or Firm*—Oliff & Berridge, PLC

(57) ABSTRACT

When a state, in which the temperature detected by a thermistor for detecting the temperature of a heating roller does not increase, is continued for 15 seconds, even though the printing operation is performed and a heater for heating the heating roller is energized, it is determined that the temperature of the heating roller does not increase normally. The same determination process is performed again while the printing operation is inhibited from being started with respect to a new sheet. In this determination process, when it is determined that the temperature of the heating roller increases normally, it is not determined as an error state. The printing operation is resumed. On the other hand, when it is determined that the temperature of the heating roller does not increase normally, the printing operation is inhibited.

14 Claims, 7 Drawing Sheets

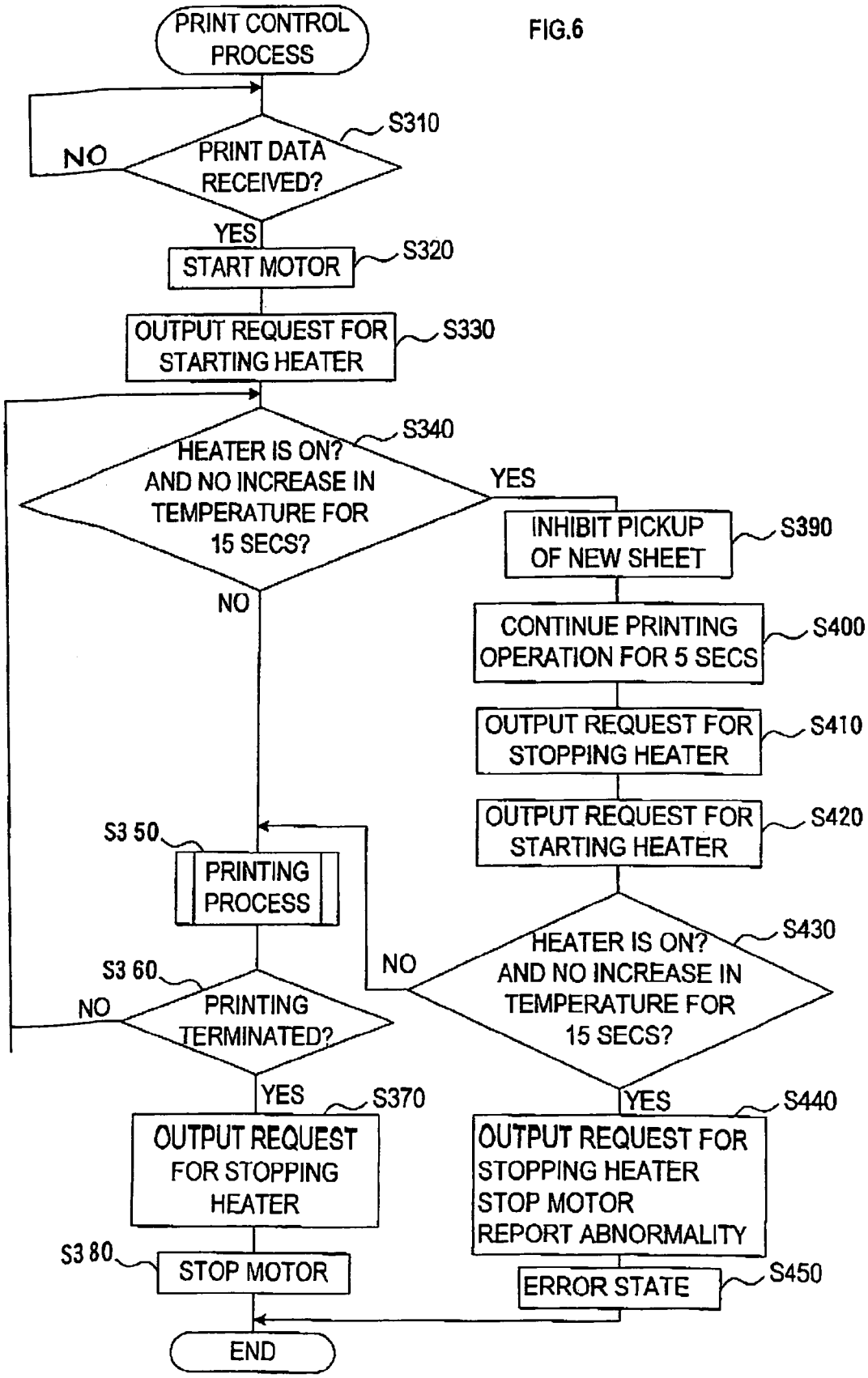
FIG.6
PRINT CONTROL PROCESS
S310
PRINT DATA RECEIVED?
NO
YES
S320
START MOTOR
S330
OUTPUT REQUEST FOR STARTING HEATER
S340
HEATER IS ON? AND NO INCREASE IN TEMPERATURE FOR 15 SECS?
YES
NO
S390
INHIBIT PICKUP OF NEW SHEET
S400
CONTINUE PRINTING OPERATION FOR 5 SECS
S410
OUTPUT REQUEST FOR STOPPING HEATER
S420
OUTPUT REQUEST FOR STARTING HEATER
S3 50
PRINTING PROCESS
S430
HEATER IS ON? AND NO INCREASE IN TEMPERATURE FOR 15 SECS?
NO
S3 60
PRINTING TERMINATED?
NO
YES
S370
OUTPUT REQUEST FOR STOPPING HEATER
YES
S440
OUTPUT REQUEST FOR STOPPING HEATER STOP MOTOR REPORT ABNORMALITY
S3 80
STOP MOTOR
ERROR STATE
S450
END

IMAGE FORMING APPARATUS FORMING AN IMAGE BY THERMALLY FIXING A DEVELOPED IMAGE

BACKGROUND OF THE INVENTION (1) Field of the Invention

The present invention relates to an image forming apparatus which forms an image by thermally fixing a developed image transferred on a recording medium.

(2) Background Art

An image forming apparatus, for example, like a laser printer, which forms an image by conveying a recording medium such as paper, transferring a developed image on the recording medium, and thermally fixing the developed image, has been conventionally known. Generally, the image forming apparatus comprises a heating body such as a heat roller for contacting a recording medium in a highly heated condition to thermally fix a developed image transferred on the recording medium, and a temperature sensor for detecting the temperature of the heat body. Based on the temperature detected by the temperature sensor, the image forming apparatus controls the temperature of the heat body suitable for thermal fixing.

In such an image forming apparatus, temperature control of the heating body can not be correctly performed, for example, if a heat source for heating the heating body is broken down and consequently the heating body is not adequately heated, and if the temperature sensor does not correctly detect the temperature of the heating body due to change in positional relationship between the heating body and the temperature sensor.

There is provided an image forming apparatus in which the image forming operation is not performed when the temperature of the heating body is determined as abnormal based on the temperature detected by the temperature sensor. However, it is not preferable that the image forming operation is not performed immediately after the temperature sensor temporarily mis-detects the temperature due to noise. Therefore, the number of times, in which the temperature of the heating body is determined as abnormal, is counted. Until the number of times reaches a predetermined number, the image forming operation can be resumed. When the number of times reaches a predetermined number, the image forming operation can not be performed (for example, see Publication of Unexamined Japanese Patent Application 8-292679).

SUMMARY OF THE INVENTION

In order to raise the temperature of the heating body at short time after the image forming apparatus is turned on, the heat capacity of the heating body tends to be smaller.

However, the smaller the heat capacity is, the larger the degree of decrease in temperature is, when heat is taken. For example, during the image forming operation, since the recording medium is contacted with the heating body, the heat of the heating body is taken by the recording medium. In this case, the temperature of the heating body is rapidly decreased. Due to this, even though the heat source for heating the heating body is not broken down and the temperature of the heating body is correctly detected by the temperature sensor, it may be determined that the temperature of the heating body does not increase normally during the image forming operation. Specifically, since the heat capacity of the heat source becomes small when the image forming apparatus is used near the lower limit of the rated power voltage, such a problem is likely to occur.

In the configuration described in the Publication of Unexamined Japanese Patent Application 8-292679, when the number of times determined as abnormal reaches a predetermined number irrelevant to the reason why the temperature of the heating body is not normal, the image forming operation is forbidden. This configuration does not fundamentally solve the problem.

An object of the present invention is to overcome the above described shortcomings of the prior art and to accurately determine why the temperature of the heating body does not increase normally during the image forming operation.

To attain the above and other objects, an image forming apparatus performs an image forming operation, in which an image is formed on a recording medium, by conveying the recording medium, transferring a developed image on the recording medium, contacting the recording medium on which the developed image has been transferred with a heated heating body so as to thermally fix the developed image. The image forming apparatus comprises temperature detection device for detecting the temperature of the heating body. The first determination device determines whether or not the temperature of the heating body increases normally based on the temperature detected by the temperature detection device with the image forming operation performed. When it is determined by the first determination device that the temperature of the heating body does not increase normally, the second determination device determines whether or not the temperature of the heating body increases normally based on the temperature detected by the temperature detection device in a state in which the image forming operation is inhibited from being started with respect to a new recording medium.

Namely, in the image forming apparatus of the present invention, when it is determined that the temperature of the heating body does not increase normally during the image forming operation, the image forming operation is not started with respect to a new recording medium. Whether or not the temperature of the heating body increases normally is determined again.

Therefore, according to the image forming apparatus, when it is determined that the temperature of the heating body does not increase normally during the image forming operation, the reason can be accurately determined.

That is, as reasons why it is determined the temperature of the heating body does not increase normally during the image forming operation, it can be considered that the heating body is not appropriately heated, and that the temperature of the heating body is not correctly detected by the temperature detection device. In these cases, it is not preferable to perform the image forming operation (it is preferable to make the image forming apparatus un-usable). On the other hand, another reason can be considered. For example, the heat of the heating body is taken by the recording medium. Thereby, the temperature of the heating body is temporarily decreased. In this case, the image forming operation can be performed (it is not preferable to make the image forming apparatus un-usable).

In the image forming apparatus when it is determined by the first determination device that the temperature of the heating body does not increase normally during the image forming operation, the second determination device determines whether or not the temperature of the heating body increases normally in the state in which the image forming operation is inhibited from being started with respect to a new recording medium. Namely, whether or not the temperature of the heating body increases normally is determined with the image forming operation not performed.

Therefore, when it is determined by the second determination device that the temperature of the heating body does not increase normally, it can be determined that it is because the heating body is not appropriately heated and the temperature of the heating body is not correctly detected by the temperature detection device. On the other hand, when it is determined by the second determination device that the temperature of the heating body increases normally, it can be determined that it is because the temperature of the heating body is temporarily decreased by deprival of the heat of the heating body by the recording medium during the image forming operation. Thus, by determining the reason why the temperature of the heating body does not increase normally during the image forming operation, the appropriate procedure can be performed in accordance with the reason.

In the second determination device, it is preferable to be configured so that whether or not the temperature of the heating body increases normally is determined at the time period in which the recording medium is not in contact with the heating body by inhibiting start of the image forming operation with respect to a new recording medium. That is, for example, in case the second determination device is configured to make a determination based on the detected temperature within a predetermined time period, at least a part of the predetermined time period is put in a state in which the heating body is not in contact with the recording medium. By doing this, whether or not the temperature of the heating body increases normally with the recording medium not in contact with the heating body is reliably determined.

In the image forming apparatus, the heating body is preferably configured to be heated by energization of a heat source. The first determination device and the second determination device determine that the temperature of the heating body does not increase normally, when the temperature detected by the temperature detection device does not increase for a predetermined time period even though the heat source is energized. According to this configuration, it can be easily determined that the temperature of the heating body does not increase normally. Also, the misdetermination, in which the temperature of the heating body does not increase normally, due to the instant effect of noise, etc, can be inhibited. It may be configured so that the heating body itself is a heat source (for example, induction heating). That is, the heating body may be heated by energization Preferably in the image forming apparatus, when it is determined by the first determination device that the temperature of the heating body does not increase normally, the recording medium contacting with the heating body is conveyed until it is not in contact with heating body.

Therefore, according to the image forming apparatus, the safety can be improved, when it is determined by the first determination device that the temperature of the heating body does not increase normally. Namely, for example, when it is determined by the first determination device that the temperature of the heating body does not increase normally, the image forming operation may be promptly stopped for the determination by the second determination device. However, when the recording medium is left contacting the heating body, the recording medium is heated more than necessary. On the other hand, in the image forming apparatus of the present invention, the recording medium contacting with the heating body is conveyed until the recording medium is not in contact with the heating body. Therefore, overheating of the recording medium can be inhibited.

Preferably in the image forming apparatus, when it is determined by the first determination device that the temperature of the heating body does not increase normally, the image forming operation is continued until the image forming operation to the recording medium under the printing operation is completed.

Therefore, according to the image forming apparatus, the recording medium can be inhibited from being wasted due to cancellation of the printing operation. Namely, for example, when it is determined by the first determination device that the temperature of the heating body does not increase normally, the image forming operation may be promptly stopped for the determination by the second determination device. By doing this, the recording medium which is under the image forming operation gets wasted. However, the image forming apparatus of the present invention does not have such a problem. Additionally, overheating of the recording medium can be inhibited.

The image forming apparatus preferably comprises a pressure body for contacting the recording medium with the heating body. The heating body and the pressure body are rotated together, while they are contacted with each other. Thereby, the recording medium passing the contact part is contacted with the heating body. The second determination device makes a determination, while the heating body and the pressure body are rotated together.

Therefore, according to the image forming apparatus, overheating of the pressure body can be inhibited. That is, if it is configured so that the determination is performed by the second determination device with the heating body and the pressure body not rotated, the contact part of the pressure body with the heating body is not changed. Consequently, the heating body is partially heated. However, the image forming apparatus of the present invention can avoid such a problem.

Preferably in the image forming apparatus, when it is determined by the second determination device that the temperature of the heating body does not increase normally, the image forming operation is inhibited. Namely, when it is determined by the second determination device that the temperature of the heating body does not increase normally, it may be because the heating body is not appropriately heated and the temperature of the heating body is not correctly detected by the temperature detection device. In this case, it is not preferable to perform the image forming operation. In the image forming apparatus, the image forming operation is inhibited in this case. Therefore, the image forming operation can be inhibited from being performed, when abnormality in which the printing operation should not be performed occurs.

Preferably in the image forming apparatus, when it is determined by the second determination device that the temperature of the heating body increases normally, the image forming operation is resumed. That is, when it is determined by the second determination device that the temperature of the heating body increases normally, the temperature of the heating body decreases temporarily because the heat of the heating body is taken by the recording medium or the like. In this case, the image forming operation can be performed. In the image forming apparatus, the image forming operation is resumed in this case. Therefore, the image forming operation is not inhibited, when the state is not so abnormal that the printing operation should be inhibited.

BRIEF DESCRIPTION OF THE DRAWINGS

The present invention will now be described, by way of example, with reference to the accompanying drawings, in which:

FIG. 6 is a flowchart of a print control process; and

DETAILED DESCRIPTION OF THE PREFERRED EMBODIMENT

Figure 1:
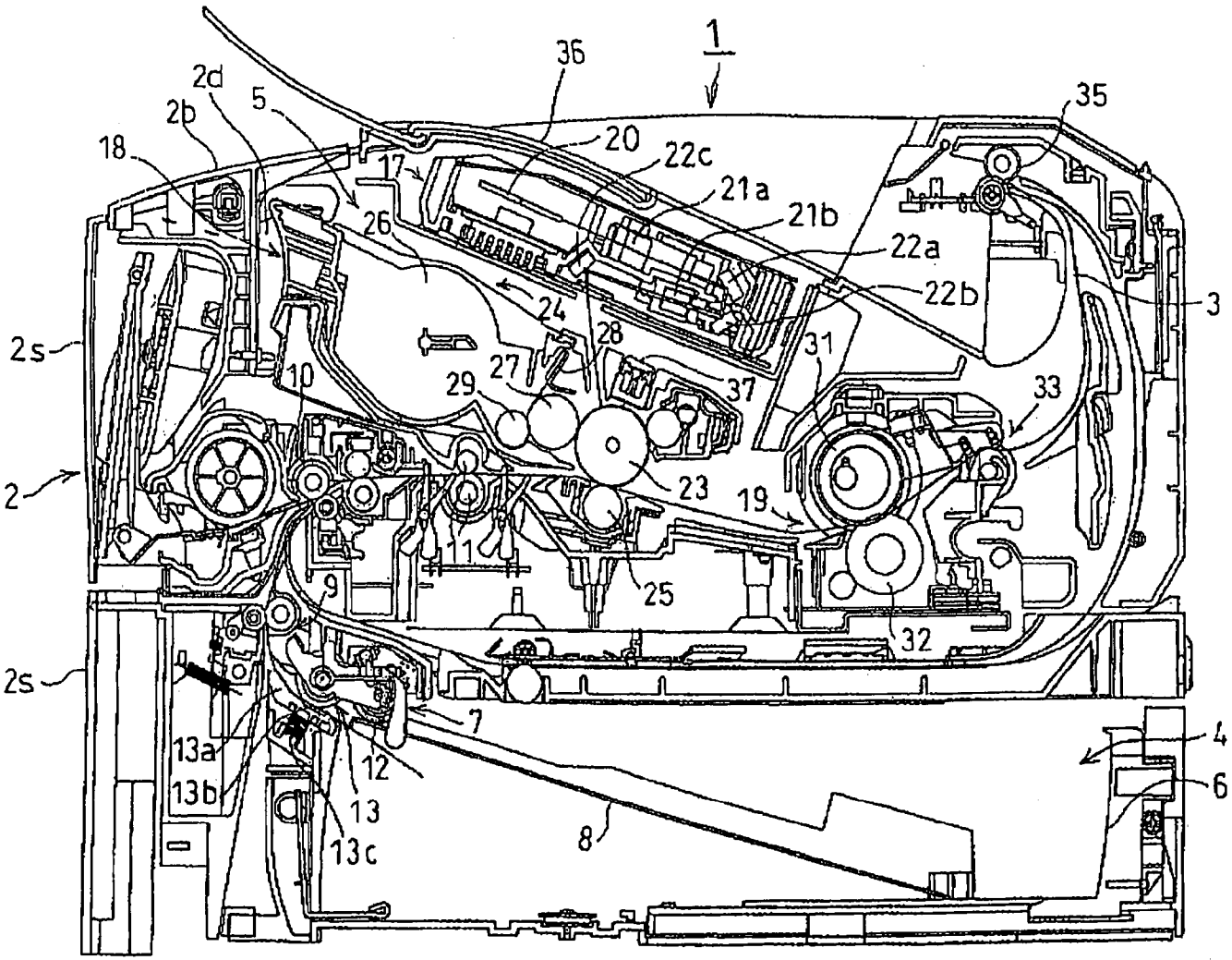
FIG. 1 is a diagrammatic representation showing a cross section of a main part of a laser printer according to the invention.

Referring to FIG. 1, the left side and the right side of FIG. 1 respectively denote the front side and the rear side of a laser printer 1. Also, the upper side and the lower side of FIG. 1 respectively denote the upper side and the lower side of the laser printer 1.

As illustrated in FIG. 1, the laser printer 1 comprises a casing main body 2, a feeding unit 4 for feeding a sheet of paper 3, and an image forming unit 5 for forming a desired image on the fed sheet 3.

The feeding unit 4 comprises, a sheet supply tray 6 attached in a freely attachable/detachable manner to the bottom of the casing main body 2, a sheet feed mechanism 7 provided to one side end of the sheet supply tray 6, a sheet pressure plate 8 provided within the sheet supply tray 6, a first feeding unit 9 and a second feeding unit 10 provided to the downstream side of the paper feed mechanism 7 in the feeding direction of the sheet 3, and register rollers 11 provided to the downstream side of the first feeding unit 9 and the second feeding unit 10 in the feeding direction of the sheet 3.

The sheet supply tray 6 having the upper surface opened is box-shaped, in which the sheet 3 can be accommodated in the form of stacked paper. The sheet supply tray 6 is attached horizontally in an attachable/detachable manner to the bottom of the casing main body 2.

The sheet feed mechanism 7 as friction separation system comprises a sheet feed roller 12 and a separation roller 13. A support frame 13*a*, a pad member 13*b*, and a spring 13*c* are provided opposite to the separation roller 13.

The plurality of sheets 3 are stacked on the sheet pressure plate 8. A rear end far from the paper feed roller 12 of the sheet pressure plate 8 is pivotally supported. Thereby, the other end of the sheet pressure plate 8 is swingably movable. Also, the sheet pressure plate 8 is upwardly biased by a spring (not shown) from the backside. For this reason, as the stack amount of the sheet 3 increases, the sheet pressure plate 8 swings downwardly while being pressed by the biasing force of the spring. The uppermost sheet of the stacked sheets placed on the sheet pressure plate 8 is pressed toward the sheet feed roller 12 by the spring. The sheet 3 is sandwiched and conveyed between the separation roller 13 and the pad member 13*b* by rotation of the sheet feed roller 12. Thereafter, each sheet is separated. Thus, the fed sheet 3 is conveyed to an image forming unit 5.

The image forming unit 5 comprises a scanner 17, a process cartridge 18, and a thermal fixing unit 19 etc.

The scanner 17 is located in the upper part of the casing main body 2 and provided with a laser emission unit (not shown), a polygon mirror 20, lenses 21*a* and 21*b*, and reflecting mirrors 22*a*, 22*b*, and 22*c* etc. Laser beam based on a certain image data emitted from the laser emission unit is passed or reflected in the order of the polygon mirror 20, the lens 21*a*, the reflecting mirrors 22*a* and 22*b*, the lens 21*b*, and the reflecting mirror 22*c*, and irradiated on the surface of a photoconductor drum 23 of the process cartridge 18 with high speed scanning.

The process cartridge 18 is located under the scanner 17, and is attached in an attachable/detachable manner to the casing main body 2. Namely, the process cartridge 18 is placed within a cavity 2*d* adjacent to a front panel 2*s* on the front side of the casing main body 2. The process cartridge 18 can be inserted into the cavity 2*d* when a body cover 2*b* attached to the casing main body 2 is opened. The process cartridge 18 comprises the photoconductor drum 23, a developing cartridge 24, a transfer roller 26, and a scorotron type charger 37. The developing cartridge 24 is attached in an attachable/detachable manner to the process cartridge 18. The developing cartridge 24 comprises a toner accommodation unit 26, a developing roller 27, a layer thickness regulation blade 28, and a toner supply roller 29 etc.

The toner accommodation unit 26 is filled with toner as developing agent. Toner is supplied to the developing roller 27 by the toner supply roller 29. Furthermore, the toner is carried as a thin layer with a specified thickness on the developing roller 27 by the layer thickness regulation blade 28. On the other hand, the photoconductor drum 23 is positioned facing the developing roller 27 in a rotatable manner. The main body of the photoconductor drum 23 is grounded, and the surface of the drum is provided with a positively-charged photosensitive layer constituted by polycarbonate or the like.

After being uniformly positively charged by the scorotron type charger 37 with rotation of the photoconductor drum 23, the surface of the photoconductor drum 23 is exposed by high-speed scanning of the laser beam from the scanner 17. And the electrostatic latent image is formed based on a certain image data. Subsequently, the toner carried on the developing roller 27 and positively charged is supplied to the electrostatic latent image formed on the surface of the photoconductor drum 23. Namely, the toner is supplied where the electric potential is decreased by exposition of the laser beam within the surface of the photoconductor drum 23 uniformly positively charged. The toner is selectively carried on the surface of the photoconductor drum 23 to visualize the electrostatic latent image. Thereby, the reversal development is achieved.

Under the photoconductor drum 23 is disposed the transfer roller 25 opposite to the photoconductor roller 23. In the transfer roller 25, a metallic roller shaft is covered with a roller formed by an electrically conductive rubber. A specified transfer bias is applied to the transfer roller 26. Consequently, a toner image (visible image) as developed image carried on the photoconductor drum 23 is transferred on the sheet 3, while the sheet 3 passes between the photoconductor drum 23 and the transfer roller 25. Thus, the sheet 3 on which the toner image has been transferred is conveyed to the thermal fixing unit 19.

Figure 2:
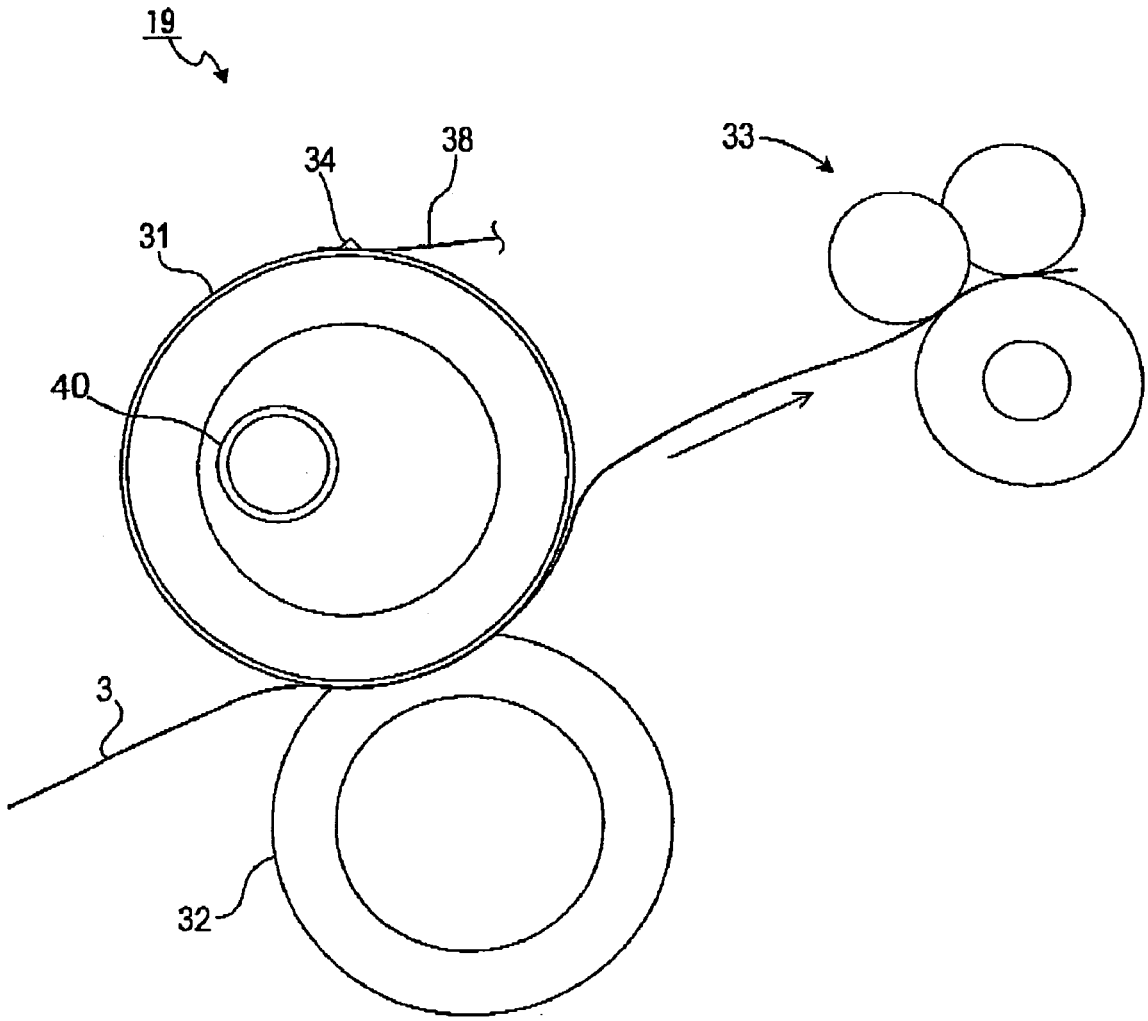
FIG. 2 is an explanatory view of a thermal fixing unit of the laser printer.

The thermal fixing unit 19 is positioned behind the process cartridge 18. As illustrated in FIG. 2, the thermal fixing unit 19 comprises a heating roller 31, a pressure roller 32 pressed against the heating roller 31, a feeding roller 33 provided more downstream of the heating roller 31 and the pressure roller 32 in the transfer direction of the sheet 3, and a thermistor 34 for detecting the temperature of the surface of the heating roller 31.

The cylindrical heating roller 31 is formed by draw molding of metal such as aluminum. The heating roller 31 is rotated by a motor 52.

Further, the heating roller 31 is provided with a heater 40 inside. The heater 40 is constituted by one or more halogen lamps which generate heat by energization. The heater 40 is arranged within the heating roller 31 along the axial direction of the heating roller 31 in order to heat the heating roller 31.

The pressure roller 32 is constituted so that a metallic roller shaft is covered with a roller made of a heat-resisting rubber. The pressure roller 32 is positioned under and opposite to the heating roller 31. The pressure roller 32 is pressed against the heating roller 31. Also, the pressure roller 32 is supported in a rotatable manner. When the heating roller 31 is rotated, the pressure roller 32 follows the rotation of the heating roller 31.

The thermistor 34 is a contact type temperature sensor. The thermistor 34 is disposed on a metallic flat plate 38 provided in a state in which the flat plate 38 is pressed against the surface of the heating roller 31. The thermistor 34 is attached facing the heating roller 31 via the flat plate 38.

In the thermal fixing unit 19, the heating roller 31 and the pressure roller 32 are contacted with each other, and are rotated together. The sheet 8 passing the contact part (nip part) is sent, while being contacted with the heating roller 31. The toner image transferred on the sheet 3 is fixed. As described above, while the sheet 3 is conveyed by the heating roller 31 and the pressure roller 32, the toner image can be fixed on the sheet 3. Thus, fixing can be effectively achieved. The sheet 3 on which the toner image has been fixed is sent onto a discharge tray 36 by a discharge roller 35.

Next, an electric constitution of the laser printer 1 will be described with: reference to the block diagram of FIG. 8.

Figure 3:
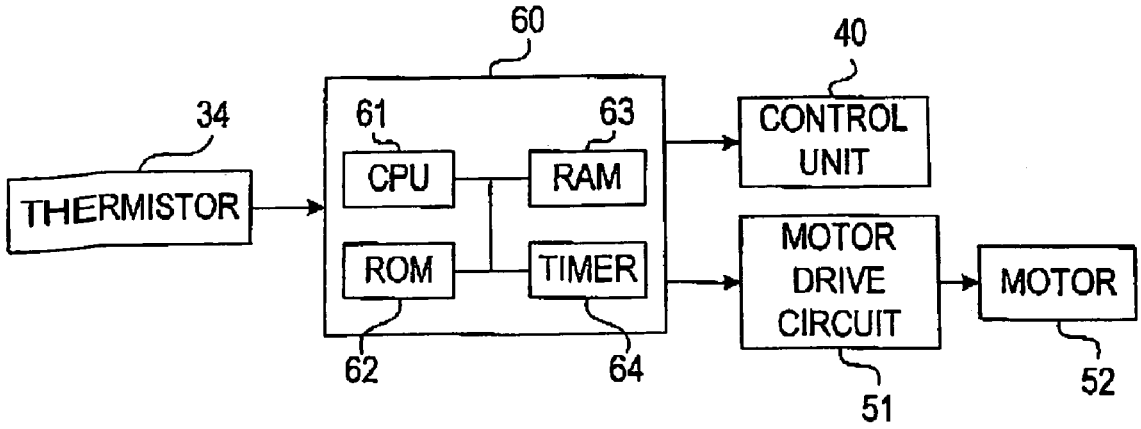
FIG. 3 is a block diagram of an electric configuration of the laser printer according to the invention.

As shown in FIG. 3, the laser printer 1 comprises the heater 40, the thermistor 34, a motor drive circuit 51 for driving a motor 52 generating the rotational drive force of various rollers provided to the laser printer 1, and a control unit 60 for controlling these.

The motor 52 is for rotating the resist rollers 11, the feed roller 12, the separation roller 13, the photoconductor drum 23, the transfer roller 25, the developing roller 27, the toner supply roller 29, the heating roller 31, the feeding roller 33, and the discharge roller 35 or the like. That is, all of these rollers are simultaneously rotated by drive of the motor 52. However, the transmission mechanism of the rotational drive force from the motor 52 to both the feed roller 12 and the separation roller 13 is constituted so that whether or not the rotational drive force is transmitted can be selected. Even in the state in which the motor is driven, the sheet 3 can be fed at an appropriate timing.

The control unit 60 comprises a CPU 61, ROM 62, RAM 63 and a timer 64. The control unit 60 performs various processes such as a heater control process (FIG. 4), an error detection process (FIG. 5), and a print control process (FIG. 6) to be hereinafter described according to a program previously stored in the ROM 62. The timer 64 is used for timekeeping in the print control process to be hereinafter described (S340, S400, and S430 in FIG. 6).

Figure 4:
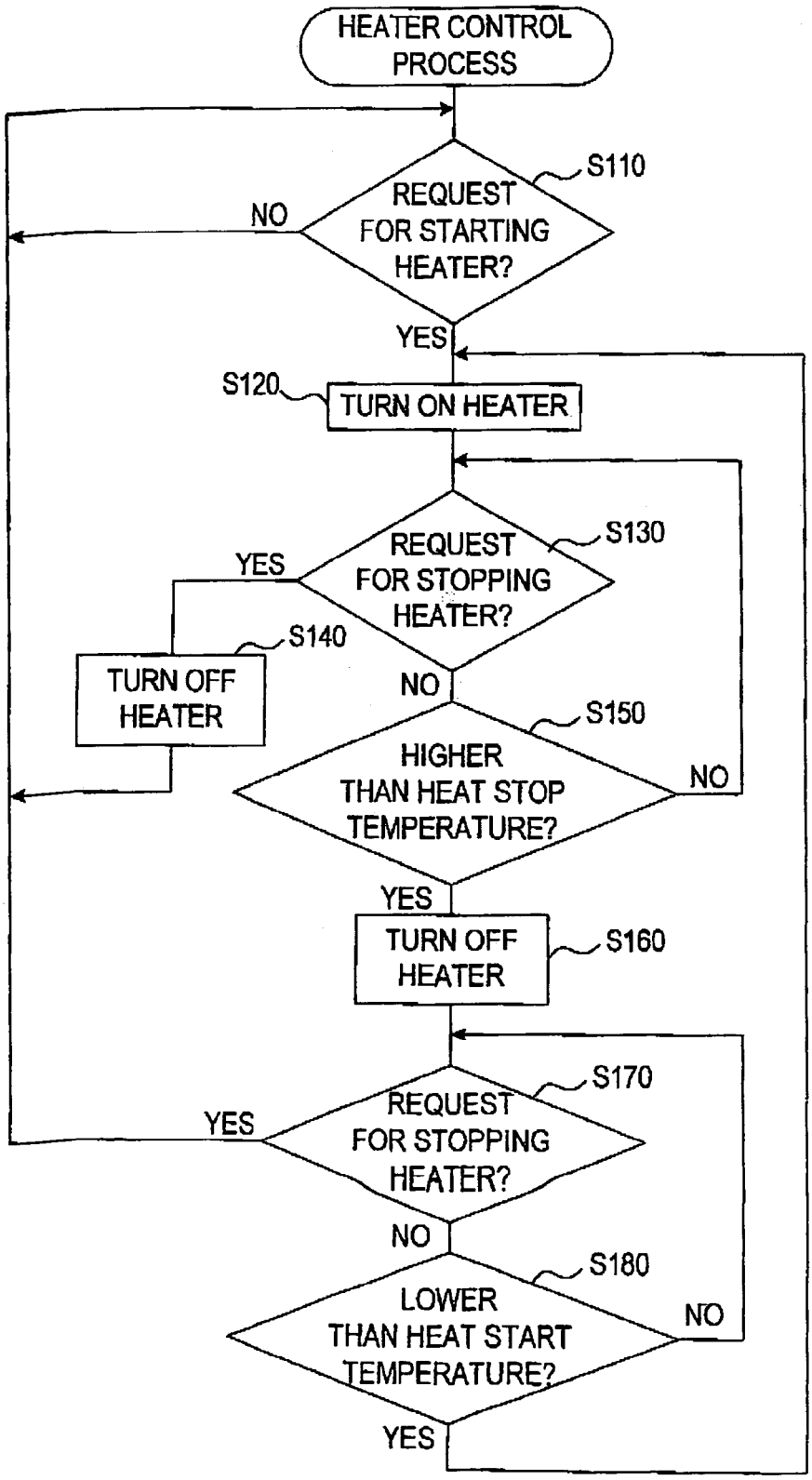
FIG. 4 is a flowchart of a heater control process.

Here is described the heater control process performed by the control unit 60 with reference to a flow chart of FIG. 4. The heater control process is for maintaining the temperature of the heating roller 31 suitable for thermal fixing of the toner image. The heater control process is performed with the laser printer 1 turned on.

Once the heater control process is started, first in S110, a stand-by state is rendered until a request for starting the heater is outputted by the processes of S330 or S420 in the print control process to be described hereinafter (FIG. 6). When it is determined that the heating request has been outputted, the procedure moves to S120.

In S120, the heater 40 is turned on (energization of the heater 40 is started).

Subsequently, in S130, it is determined by S220 of the error detection process described hereafter (FIG. 5), or S370, 410, or S440 of the print control process (FIG. 6), whether or not a request for stopping the heater has been outputted.

In S130, when it is determined that the request for stopping the heater has been outputted, the procedure moves to S140. After the heater 40 is turned off (energization of the heater is stopped), the procedure returns to S110.

On the other hand, when it is determined that the request for stopping the heater has not been outputted, the procedure moves to S150. Whether or not the temperature detected by the thermistor 34 is higher than the heat stop temperature (180° C. in the present embodiment) is determined.

In S150, when it is determined that the temperature detected by the thermistor 34 is not higher than the heat stop temperature, the procedure moves to S130.

On the other hand, in S150, when it is determined that the temperature detected by the thermistor 34 is higher than the heat stop temperature, the procedure moves to S160. The heater 40 is turned off. The procedure moves to S170. However, even though the heather 40 is turned off, it is not instantly reflected to the temperature of the heating roller 31 due to the effect of heat transmission or the like. That is, after getting slightly higher than the heat stop temperature (180° C.), the temperature of the heating roller 31 starts decreasing.

In S170, as in S130, whether or not the request for stopping the heater has been outputted is determined.

In S170, when it is determined that the request for stopping the heater has been outputted, the procedure returns to S110.

On the other hand, in S170, when it is determined that the request for stopping the heater has not been outputted, the procedure moves to S180 to determine whether or not the temperature detected by the thermistor 34 is lower than the heat start temperature (180° C. in the present embodiment).

In S180, when it is determined that the temperature detected by the thermistor 34 is not lower than the heat start temperature, the procedure returns to S170.

On the other hand, in S180, when it is determined that the temperature detected by the thermistor 34 is lower than the heat start temperature, the procedure returns to S120 to repeat the aforementioned process. As described above, even though the heater 40 is turned on, it is not instantly reflected to the temperature of the heating roller 31 due to the effect of heat transmission or the like. That is, after getting slightly lower than the heat stop temperature (180° C.), the temperature of the heating roller 31 starts increasing.

In the heater control process, the request for starting the heater is outputted. The temperature control is started for maintaining the temperature of the heating roller 31 suitable for thermal fixing of the toner image. The request for stopping the heater is outputted. The temperature control is terminated.

In the present embodiment, the heat stop temperature and the heat start temperature are set at the same temperature (180° C.). However, the temperature is not restricted to this. The heat stop temperature and the heat start temperature may be different. For example, the heat stop temperature is 185° C., and the heat start temperature is 175° C. The temperature of the heating roller 31 may be controlled within the temperature range.

Figure 5:
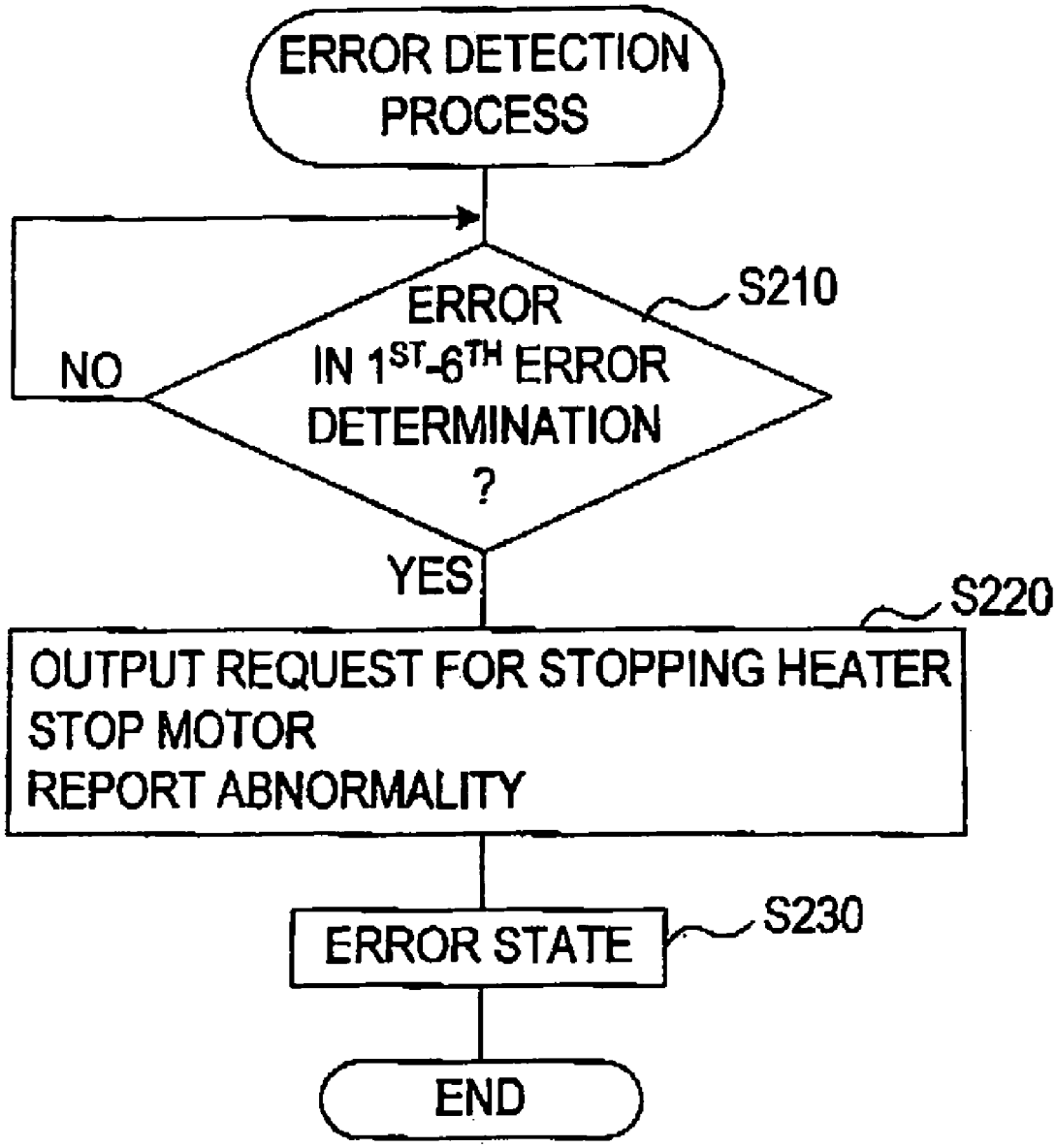
FIG. 5 is a flowchart of an error detection process.

Next, an error detection process performed by the control unit 60 will be described with reference to a flowchart of FIG. 5. The error detection process is to make the laser printer 1 un-usable, when abnormality in which the printing operation should not be performed occurs. The error detection process is started by turning on the power of the laser printer 1.

Once the error detection process is started, first in S210, whether or not the error determination is performed by any one of the first to sixth error determination is determined.

[The First Error Determination]

The elapsed time is counted from the point when the laser printer 1 is turned on to the point when the temperature detected by the thermistor 34 reaches the temperature for the first determination (60° C. in the present embodiment). If the temperature detected by the thermistor 34 does not reach the temperature for the first determination after the first time limit T1 (12 seconds in the present embodiment) passes, it is determined as error.

In the present laser printer 1, after the power is turned on, if the heater 40 is temporarily turned off by an error, etc before the first time limit T1 passes, the counting is stopped during that time. Furthermore, the count is reduced according to the time period in which the heater is turned off. In the present embodiment, the temperature of the heating roller 31 decreases by 1° C. for 10 seconds with the heater 40 turned off. The temperature of the heating roller 31 increases by 7° C. for one second with the heater 40 turned on. Based on that calculation, the count is reduced by 1 second, each time the time period, in which the heater 40 is turned off, passes 70 seconds. Thereby, even if the heater is temporarily turned off, the appropriate determination can be performed.

[The Second Error Determination]

The time period from the point when the temperature detected by the thermistor 34 reaches the temperature for the first determination (60° C. in the present embodiment) to the point when the detected temperature reaches the temperature for the second determination (100° C. in the present embodiment), is counted. If the temperature detected by the terminator 34 does not reach the temperature for the second determination even after the second time limit T2 (7 seconds in the present embodiment) passes, it is determined as error. If the heater 40 is temporarily turned off, the count adjustment can be performed like the error determination of the first error determination.

[The Third Error Determination]

If a state, in which the temperature detected by the thermistor 34 exceeds the temperature for the third determination (270° C. in the present embodiment), is continuously detected for a predetermined time period (is detected more than once in succession, if the temperature is regularly determined), it is determined as error. The temperature for the third determination is higher than the temperature of the heating roller 31 which is controlled during the print operation (180° C. in the present embodiment).

[The Fourth Error Determination]

The determination is started at the point when the temperature detected by the thermistor 34 becomes lower than the temperature for the fourth determination (100° C. in the present embodiment). The temperature for the fourth determination is lower than the temperature of the heating roller 31 that is controlled during the print operation (180° C. in the present embodiment). If the temperature detected by the thermistor 34 decreases to the temperature for the fifth determination (60° C. in the present embodiment) which is lower than the temperature for the fourth determination, Number of occurrence of abnormality is counted to terminate the determination. If number of occurrence of abnormality is thus counted ten times, it is determined as error.

[The Fifth Error Determination]

If the temperature detected by the thermistor 34 is rapidly increased (at rate of 50° C. per minute ) in a state in which the detected temperature is higher than the temperature for the sixth determination (60° C. in the present embodiment), it is determined as error caused by short of the thermistor circuit.

[The Sixth Error Determination]

If the temperature detected by the thermistor 34 is rapidly decreased (at a rate of 25° C. per minute) in a state in which the detected temperature is higher than the temperature for the sixth determination, it is determined as error caused by disconnection of the thermistor circuit.

In S210, the stand-by state is kept until the error determination is made by any one of the first to sixth error determination. If the error determination is made, the procedure moves to S220.

In S220, the request for stopping the heater is outputted to turn off the heater 40. The motor 52 is stopped to terminate the image forming operation. Further, the abnormality report is conducted with an operation panel (not shown) so as to inform a user that repair is required.

In 230, after the procedure moves to an error state in which the laser printer 1 is un-usable (repair waiting state), the error detection procedure is terminated.

Thus, if the error determination is conducted by any one of the first to sixth error determination, the error detection process makes the laser printer 1 un-usable (repair waiting state) so as to inhibit the printing operation.

Next, a print control process performed by the control unit 60 will be described with reference to a flow chart of FIG. 6. The print control process is started by turning on the laser printer 1.

Once the print control process is started in S310, the stand-by state is kept until print data is received as a print start command which is sent from an external device such as a personal computer via an interface (not shown). When it is determined that the print data has been received, the procedure moves to S320.

In S320, drive of the motor 52 is started by the motor drive circuit 51.

Subsequently, in S330, the request for starting the heater is outputted so as to control the temperature of the heating roller 31 suitable for thermal fixing of the toner image.

In S340, it is determined whether or not the heater 40 is on. Also, it is determined whether or not a state, in which the temperature detected by the thermistor 34 shows no increase compared to the temperature one second before, has been continued for a predetermined period (15 seconds in the present embodiment). That is, whether or not the temperature detected by the thermistor 34 shows an increase compared to the temperature one second before is determined every second. Whether or not the state, in which the temperature shows no increase, has continued 15 times, is determined.

In S340, when it is not determined that the above described state has continued for 15 seconds (namely, the temperature of the heating roller 31 does not increase normally) (S340: NO), the procedure moves to S350 to perform a normal printing operation. The normal printing operation is a known procedure for performing the printing operation (the image forming operation). Specifically, the sheet 3 is picked up (supplied) at a certain timing. While the sheet 3 is conveyed, the toner image is transferred on the sheet 3. The sheet 3 on which the toner image has been transferred is contacted with the heating roller 31 controlled at the temperature suitable for thermal fixing of the toner image. The toner image is thermally fixed. And the image is printed on the sheet 3.

In S360, whether or not the printing process with respect to the print data received in S310 has been terminated is determined.

When it is determined that the printing process has not been terminated in S360, the procedure returns to S340 to repeat the processes described above.

On the other hand, in S360, when it is determined that the printing process has been terminated, the procedure moves to S370. The request for stopping the heater is outputted. The temperature control for maintaining the temperature of the heater 40 suitable for thermal fixing of the toner image is stopped. Further, after the procedure moves to S380 to stop the motor 52, the print control process is terminated.

In the aforementioned S340, when it is determined that the above described state has been kept for 15 seconds (that is, the temperature of the heating roller 31 does not increase normally), the procedure moves to S390. A new sheet 3 to which the printing operation has not been performed is inhibited from being picked up.

In S400, the printing operation is continued for a predetermined period (5 seconds in the present embodiment) until the printing operation is completed with respect to the sheet 3 which has been picked up and to which the printing operation has been started. Namely, the printing operation is completed with respect to the sheet 3 under the printing process. However, the printing operation is not started with respect to the sheet 3 to which the printing operation has not been started.

In S410, the request for stopping the heater is outputted. In S420, the request for starting the heater is outputted. That is, it is configured so that the heater 40 is once turned off. It is because the determination process of S430 described hereinafter (the similar to S340 described above) is started in a state in which there is no sheet 3 under the printing process due to the S400. Thus, the heater is once turned off. The determination is newly started.

In S430, as in S340, it is determined whether or not the heater 40 is turned on. Also, it is determined whether or not the temperature detected by the thermistor 34 shows no increase compared to the temperature one second before has been continued for 15 seconds. In this state, there is no sheet 3 under the printing process. However, the motor 52 is in a state of being driven. Both the heating roller 31 and the pressure roller 32 are in a rotating state In S430, when it is determined that the above described state has not been continued for 15 seconds (that is, the temperature of the heating roller 31 increases normally), the procedure moves to S350 to proceed the normal printing process.

On the other hand, in S430, when it is determined that the above described state has been continued for 15 seconds (that is, the temperature of the heating roller 31 does not increase normally), the procedure moves to S440. As in S220 of the error detection process (FIG. 5) described above, the request for stopping the heater is outputted to turn off the heater 40. The motor 52 is stopped. The image forming operation is stopped. Furthermore, the abnormality report is conducted with an operation panel (not shown).

In S450, as in S230, the procedure moves to the error state which makes the laser printer 1 un-usable (the repair waiting state). The print control process is terminated.

Thus, in the print control process, whether or not the temperature of the heating roller 31 increases normally is determined based on the temperature detected by the thermistor 34 with the printing operation performed (S340). When it is determined that the temperature of the heating roller 31 does not increase normally (S340: YES), start of the printing operation with respect to the new sheet 3 is inhibited. Whether or not the temperature of the heating roller 31 increases normally is determined based on the temperature detected by the thermistor 34 with the printing operation not performed (S430). Thus, when it is determined that the temperature of the heating roller 31 increases normally with the printing operation not performed (S430: NO), it is not specified as error. The printing operation is resumed. Conversely, when it is determined that the temperature of the heating roller 31 does not increases normally even with the printing operation not performed (S430: YES), the laser printer 1 is made un-usable (the repair waiting state) to inhibit the printing operation.

Next, examples of the operation of the laser printer 1 will be described with reference to FIG. 7.

Figure 7:
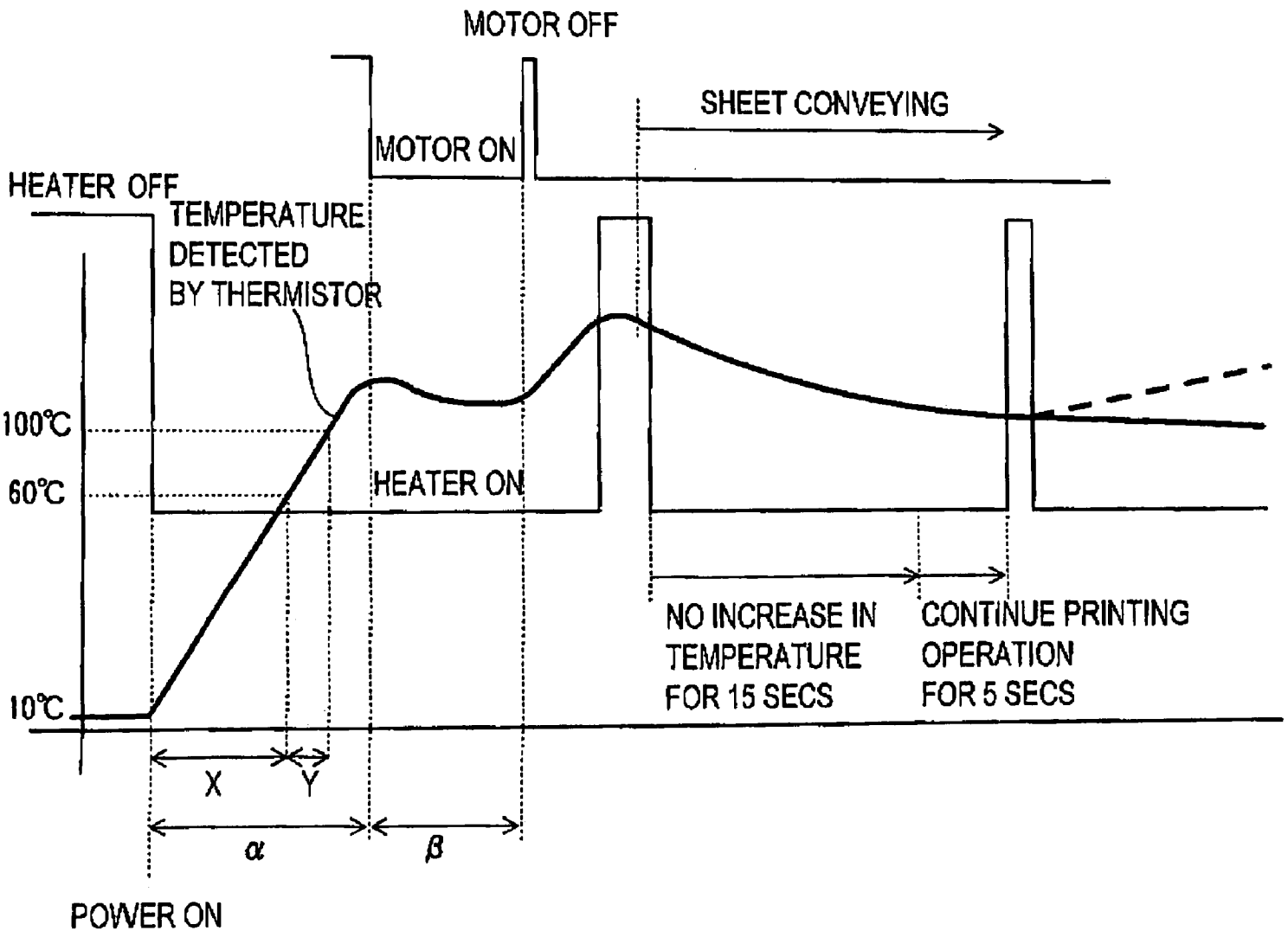
FIG. 7 is an explanatory view of an operation of the laser printer according to the invention.

As shown in FIG. 7, after the power of the laser printer 1 is turned on, the heater 40 is turned on so as to raise the temperature of the heating roller 31 to a predetermined stand-by level. Thereby, the temperature detected by the thermistor 34 increases. As described above, in case that time period X from the point when the power is turned on to the point when the temperature detected by the thermistor 34 reaches the temperature for the first determination (60° C.) exceeds the first time limit T1 (12 seconds), it is determined as error by the first error determination (S230 to S230). Similarly, in case that time period Y from the point when the temperature detected by the thermistor 34 reaches the temperature for the first determination (60° C.) to the point when the detected temperature reaches the temperature for the second determination (100° C.) exceeds the second time limit T2 (7 seconds), it is determined as error by the second error determination (S210 to S230).

After the power is turned on and a predetermined time period $\alpha$ is passed, the drive of the motor 52 is started as early stage of the operation. Thereby, the heating roller 31 and the pressure roller 32 are rotated. In this case, the heat of the heating roller 41 is taken by the pressure roller 32. The temperature detected by the thermistor 34 decreases.

After a predetermined time period $\beta$ passes from the start of the early stage of the operation, the early stage of the operation is finished. The motor 52 is stopped. The printing operation is started. In this case, on and off control of the heater 40 is performed by the aforementioned heater control process (FIG. 4).

Even though the heater 40 is turned on (the heater 40 is energized), the temperature detected by the thermister 34 does not increase for 15 seconds (S340: YES). In this case, it is determined that the temperature of the heating roller 31 does not increase normally. Pick up of a new sheet 3 is inhibited (S390). Furthermore, the printing operation is continued for 5 seconds (S400) to complete the printing operation with respect to the sheet 3 under the printing process. Thereby, the sheet 3 in contact with the heating roller 31 is conveyed until the sheet 3 is not in contact with the heating roller 31.

Here, the heater 40 is once turned off (S410 and S420) so as to resume the determination (S430). In this determination, if the temperature detected by the thermistor 34 increases as shown by dashed line shown in FIG. 7 (S430: NO), it is determined that it result from temporal decrease in temperature caused by deprivation of the heat of the heating roller 31 by the sheet 3. The printing operation is continued (S350). On the other hand, if the temperature detected by the thermistor 34 does not increase for 16 seconds as shown by solid line (S430: YES), the reason, in which the temperature of the heating roller 31 does, not increase normally, is determined as serious so that it causes trouble to the printing operation. For example, the heater 40 is not normally heated due to disconnection of the wire or circuit to the heater or the like. And the temperature of the heating roller 31 is not normally detected by the thermistor 34, because paper piece is sandwiched between the flat plate 38 and the heating roller 31. Consequently, the laser printer 1 is put in the un-usable state (repair waiting state) (S440 and S450).

As described above, in the laser printer 1 of the present embodiment, when it is determined that the temperature of the heating roller 31 does not increase normally under the printing process, it is confirmed whether or not the temperature of the heating roller 31 does not increase normally even with the printing operation not performed. If the temperature of the heating roller 31 increases normally with the printing operation not performed, it is determined that it result from deprivation of the heat of the heating roller 31 by the sheet during the printing operation. The printing operation is resumed. On the other hand, if the temperature of the heating roller 31 does not increase normally even with the printing operation not performed, it is determined that the state of the printer is so serious that the printing operation should be inhibited. For example, the factors that cause the state of the printer may be defective heating of the heater 40, and defective temperature detecting of the thermistor 34, etc. In such cases, the printing operation is inhibited.

Thus, according to the laser printer 1 of the present embodiment, when it is determined that the temperature of the heating roller 31 does not increase normally during the printing operation, diagnosis of the cause is precisely conducted. The appropriate procedure can be performed in accordance with the cause. Thereby, when unusual state in which the printing operation should be inhibited occurs, the printing operation is inhibited without fail. At the same time, the printing operation is prevented from being inhibited, when the state is not so abnormal that the printing operation should be inhibited. Specifically, when the heat capacity of the heating roller 31 is configured to be small, and the laser printer 1 is used near the minimum level of the rated voltage, the temperature decrease of the heating roller 31 gets heavy when the heating roller 31 contacts with the sheet 3. It is likely to be determined that the temperature of the heating roller 31 does not increase normally (S340). However, in this case, it can be prevented that the laser printer 1 is put in the un-usable state.

Also, in the laser printer 1, if the temperature detected by the thermistor 34 does not increase for a predetermined period (15 seconds) even though the heater 40 is energized, it is determined that the temperature of the heating roller 31 does not increase normally (S340 and S430). Thus, according to the laser printer 1, the misdetermination, in which the temperature of the heating roller 31 does not increase normally due to the effect of noise etc, can be prevented.

Furthermore, in the present laser printer 1, when it is determined that the temperature of the heating roller 31 does not increase normally during the printing process, the new sheet 3 is inhibited from being picked up. The printing operation is continued for 5 seconds. Thereby, the printing operation is completed with respect to the sheet 3 to which the printing operation has already started. For this reason, in the laser printer 1, the sheet 3 can be prevented from being left with contacting the heating roller 31. Also, the sheet 3 can be prevented from being wasted due to cancellation of the printing operation.

Additionally, in the laser printer 1, even when it is determined whether or not the temperature of the heating roller 31 increases normally with the printing operation not performed (S430), both the heating roller 31 and the pressure roller 32 are rotated together. Consequently, the pressure roller 32 can be prevented from being heated partially by the heating roller 31.

The embodiment of the present invention has been described above. However, the present invention can be adopted various modes.

For example, according to the laser printer 1 of the above embodiment, whether or not the temperature of the heating roller 31 increases normally is determined (the first determination). When it is determined that the temperature does not increase normally (S340: YES), the printing operation is completed with respect to the sheet 3 under the printing process. Then, whether of not the temperature of the heating roller 31 increases normally (the second determination) is performed (S430). However, the embodiment is not limited to this. The second determination may be started before the printing operation is completed. In this case, as long as there exists a time period, in which the sheet 3 is not in contact with the heating roller 31, among the determination period performing the second determination, the similar effect can be obtained as in the above embodiment. Specifically, in the print control process (FIG. 6) of the above embodiment, even if S410 and S420 are performed before S400, the time period until the printing operation is completed (5 seconds) is shorter than the determination period (15 seconds) for determining that the detected temperature of the heating roller 31 does not increase normally in the second determination. Consequently, the determination can be performed including the state in which the sheet 3 is not in contact with the heating roller 31.

Furthermore, in the laser printer 1 of the embodiment, it is constituted so that the heating roller 31 is heated by the heater 40. However, the embodiment is not limited to this. For example, it may be constituted so that the heating roller 31 generates heat by itself (for example, induction heating) by energization.

On the other hand, in the laser printer 1 of the embodiment, when the temperature detected by the thermistor 34 does not increase for a predetermined period even though the heater 40 is energized, it is determined that the temperature of the heating roller 31 does not increase normally (S340 and S430). However, other determination than this can be made. For example, when the rate of the temperature increase is less than a predetermined level even though the heater 40 is energized, it may be determined that the temperature of the heating roller 31 does not increase normally. When the ratio of the energization time of the heater 40 in a predetermined time period is more than a predetermined level, it may be determined that the temperature of the heating roller 31 does not increase normally. Also, when the time period in which the heating roller 31 reaches a predetermined temperature exceeds a predetermined level, it may be determined that the temperature of the heating roller 31 does not increase normally.

What is claimed is:

1. An image forming apparatus comprising:

an image forming device, including a convey device that conveys a recording medium, a transfer device that transfers a developed image on the recording medium, and a thermal fixing device that performs an image forming operation by contacting the recording medium on which the developed image has been transferred with a heated heating body so as to thermally fix the developed image;

a temperature detection device that detects the temperature of the heating body;

a first determination device that determines whether or not the temperature of the heating body increases normally based on the temperature detected by the temperature detection device with the image forming operation performed; and a second determination device that determines whether or not the temperature of the heating body increases normally based on the temperature detected by the temperature detection device in a state in which the image forming operation is inhibited from being started with respect to a new recording medium, when it is determined by the first determination device that the temperature of the heating body does not increase normally.

2. The image forming apparatus as set forth in claim 1, wherein the heating body is heated by energization of a heat source, and wherein the first determination device and the second determination device determine that the temperature of the heating body does not increase normally, when the temperature detected by the temperature detection device does not increase for a predetermined time period, even though the heat source is energized.

3. The image forming apparatus as set forth in claim 1, further comprising a convey control device that conveys the recording medium by the convey device until the recording medium contacting with the heating body is not in contact with the heating body, when it is determined by the first determination device that the temperature of the heating body does not increase normally.

4. The image forming apparatus as set forth in claim 1, further comprising an image forming control device that continues the image forming operation until the image forming operation to the recording medium by the image forming device is completed, when it is determined by the first determination device that the temperature of the heating body does not increase normally.

5. The image forming apparatus as set forth in claim 1, further comprising a pressure body that contacts the recording medium with the heating body, wherein the heating body and the pressure body are rotated together while they are contacted with each other, and contacts the recording medium passing the contact part with the heating body, and wherein the second determination device makes a determination with the heating body and the pressure body rotated together.

6. The image forming apparatus as set forth in claim 1, wherein an image forming control device inhibits the image forming operation by the image forming device, when it is determined by the second determination device that the temperature of the heating body does not increase normally.

7. The image forming apparatus as set forth in claim 6, wherein the image forming control device resumes the image forming operation by the image forming device, when it is determined by the second determination device that the temperature of the heating body increases normally.

8. An image forming method comprising the steps of:

conveying a recording medium;

transferring a developed image on the recording medium;

performing an image forming operation by contacting the recording medium on which the developed image has been transferred with a heated heating body so as to thermally fix the developed image;

detecting the temperature of the heating body;

performing a first determination of whether or not the temperature of the heating body increases normally based on the temperature detected with the image forming operation performed; and performing a second determination of whether or not the temperature of the heating body increases normally based on the temperature detected in a state in which the image forming operation is inhibited from being started with respect to a new recording medium, when it is determined that the temperature of the heating body does not increase normally.

9. The image forming method as set forth in claim 8, wherein the heating body is heated by energization of a heat source, and wherein the first determination and the second determination are performed so as to determine that the temperature of the heating body does not increase normally, when the detected temperature does not increase for a predetermined time period, even though the heat source is energized.

10. The image forming method as set forth in claim 8, wherein the recording medium is conveyed until the recording medium contacting with the heating body is not in contact with the heating body, when it is determined by the first determination that the temperature of the heating body does not increase normally.

11. The image forming method as set forth in claim 8, wherein the image forming operation is continued until the image forming operation to the recording medium is completed, when it is determined by the first determination that the temperature of the heating body does not increase normally.

12. The image forming method as set forth in claim 8, wherein the second determination is performed with the heating body and a pressure body that contacts the recording medium with the heating body rotated together.

13. The image forming method as set forth in claim 8, wherein the image forming operation is inhibited, when it is determined by the second determination that the temperature of the heating body does not increase normally.

14. The image forming apparatus as set forth in claim 13, wherein the image forming operation is resumed, when it is determined by the second determination that the temperature of the heating body increases normally.

* * * * *